US007900662B2

(12) United States Patent
Wall et al.

(10) Patent No.: US 7,900,662 B2
(45) Date of Patent: Mar. 8, 2011

(54) POWER TOOL WITH BASE CLAMP

(75) Inventors: Daniel Paxton Wall, Medina, TN (US); Craig A. Carroll, Milan, TN (US)

(73) Assignee: Black & Decker Inc., Newark, DE (US)

( * ) Notice: Subject to any disclaimer, the term of this patent is extended or adjusted under 35 U.S.C. 154(b) by 164 days.

(21) Appl. No.: 12/326,199

(22) Filed: Dec. 2, 2008

(65) Prior Publication Data

US 2009/0145521 A1 Jun. 11, 2009

Related U.S. Application Data

(60) Provisional application No. 61/005,923, filed on Dec. 7, 2007.

(51) Int. Cl.
*B27C 5/10* (2006.01)
*B27C 5/00* (2006.01)

(52) U.S. Cl. ..... 144/136.95; 409/182

(58) Field of Classification Search ..... 144/136.95, 144/154.5; 409/182, 206, 209, 210, 218
See application file for complete search history.

(56) References Cited

U.S. PATENT DOCUMENTS

| | | | | |
|---|---|---|---|---|
| 5,853,273 | A * | 12/1998 | Coffey | 409/182 |
| 5,853,274 | A * | 12/1998 | Coffey et al. | 409/182 |
| 6,726,414 | B2 * | 4/2004 | Pientka et al. | 409/182 |
| 7,121,775 | B2 * | 10/2006 | Onose et al. | 409/182 |
| 7,275,900 | B1 | 10/2007 | Phillips et al. | |
| 7,334,614 | B2 * | 2/2008 | Cooper et al. | 144/136.95 |
| 2006/0102248 | A1 | 5/2006 | Cooper et al. | |

* cited by examiner

*Primary Examiner* — Shelley Self
(74) *Attorney, Agent, or Firm* — Harness, Dickey & Pierce, P.L.C.

(57) ABSTRACT

A power tool includes a motor assembly, a base assembly, and a clamp assembly coupled to the motor assembly or the base assembly to selectively provide a retention force to the other to removably couple the motor assembly and the base assembly. The clamp assembly includes a handle member, a fulcrum member, and a biasing lever member. The lever member includes a first portion and a second portion disposed on opposite sides of the fulcrum member. The handle member is coupled to the first portion, and the handle member is movable between an open and closed position. The handle member rotates the first and second portions of the biasing lever member about the fulcrum member when moving from the open to the closed position, causing the second portion of the lever member to provide the retention force.

19 Claims, 3 Drawing Sheets

POWER TOOL WITH BASE CLAMP

CROSS-REFERENCE TO RELATED APPLICATIONS

This application claims the benefit of U.S. Provisional Application No. 61/005,923, filed on Dec. 7, 2007. The entire disclosure of that application is incorporated herein by reference.

FIELD

The present disclosure relates to a power tool and, more particularly, relates to a power tool with a base clamp.

BACKGROUND

The statements in this section merely provide background information related to the present disclosure and may not constitute prior art.

Power tools can include a motor assembly that drives a tool and a base assembly that supports the motor assembly. In some cases, the motor assembly is removably coupled to the base assembly to increase the usefulness of the tool. Typically, these power tools include a clamp assembly that is manipulated by a user to couple and decouple the motor assembly and the base assembly.

For instance, some routers include a base assembly with an outer wall that defines a central opening. The outer wall includes a longitudinally extending slit that divides the outer wall into a first and second side. The motor assembly can be positioned in the central opening of the base assembly. The router also includes a clamp assembly that can move between an open position and a closed position. When moving from the open position to the closed position, the clamp assembly pulls the first and second sides of the outer wall together such that the slit becomes narrower and such that the central opening becomes smaller. Thus, the outer wall of the base assembly constricts around the motor assembly to thereby hold the motor assembly to the base assembly. Also, when the clamp assembly moves from the closed position to the open position, the first and second sides of the outer wall move away from each other such that the slit becomes wider and such that the central opening becomes larger. Thus, the outer wall of the base assembly expands to release the motor assembly.

These clamp assemblies typically create significant clamping forces and/or require significant input force from the user, especially in cases in which the clamp assembly deflects the base assembly as described above. Thus, some users may have difficulty opening or closing the clamp assembly.

Also, in some cases, these clamp assemblies can include ramps or other camming surfaces, and the clamp assembly can actuate on the camming surface when moving from the open position to the closed position to generate sufficient holding forces. These camming surfaces can wear over time due to the significant clamping forces involved. Once these camming surfaces are sufficiently worn, the clamp assembly may not provide enough retention force for holding the motor assembly.

Moreover, some clamp assemblies are adjustable for adjusting the amount of clamping force. For instance, some clamp assemblies include an adjustment screw that can be turned to change the position of one or more camming surface to thereby change the amount of clamping force. However, adjustment of the clamp force can be difficult because the base assembly is typically quite stiff relative to the amount of camming throw. As such, the clamp assembly may prematurely wear if the clamping force is adjusted too high, and/or the base assembly can fracture due to excessive clamping force.

Furthermore, these clamp assemblies may hang relatively loose from the base assembly when in the open position. As such, it can be difficult to properly orient the clamp assembly before moving the clamp assembly to the closed position. Also, if the clamp assembly is not properly aligned before moving to the closed position, one or more camming surfaces may be subject to excessive force, which can cause additional wear.

Still further, conventional clamp assemblies can be bulky. As such, the profile of the overall tool can significantly increase due to the clamp assembly. Thus, the tool may not fit in limited spaces. Also, the power tool may be more difficult to hold due to the bulkiness of the clamp assembly.

SUMMARY

A power tool is disclosed that includes a motor assembly, a base assembly, and a clamp assembly coupled to the motor assembly or the base assembly to selectively provide a retention force to removably couple the motor assembly and the base assembly. The clamp assembly includes a handle member, a fulcrum member, and a biasing lever member. The biasing lever member includes a first portion and a second portion disposed on opposite sides of the fulcrum member. The handle member is coupled to the first portion of the biasing lever member, and the handle member is movable between an open position and a closed position. The handle member rotates the first and second portions of the biasing lever member about the fulcrum member when moving from the open position to the closed position, causing the second portion of the biasing lever member to provide the retention force to removably couple the motor assembly and the base assembly. Also, the handle member rotates the first and second portions of the biasing lever member about the fulcrum member when moving from the closed position to the open position, causing the second portion of the biasing lever member to reduce the retention force.

A router is also disclosed that includes a motor assembly, a base assembly defining an aperture and an axis, and a clamp assembly coupled to the base assembly to selectively provide a retention force to removably couple the motor assembly and the base assembly. The clamp assembly includes a handle member with a pin coupled thereto, a fulcrum member fixed to the base assembly, a biasing lever member with a first portion having a hook coupled to the pin, an adjustment member movably coupled to the base assembly, and a clamp pad coupled to a second portion of the biasing member and being received by the aperture. The first and second portions of the biasing lever member are disposed on opposite sides of the fulcrum member, and the first portion of the biasing lever member is longer than the second portion. The handle member is rotatable about an axis defined by the pin between an open position and a closed position. The handle member cams against the adjustment member when rotating from the open position to the closed position to thereby move the pin away from the axis, pulling the hook away from the axis, and rotating the first and second portions of the biasing lever member about the fulcrum member. This action resiliently deflects the biasing lever member, thereby biasing the clamp pad against the motor assembly to provide the retention force. The adjustment member is movable relative to the motor assembly to change an amount of the retention force provided by the biasing lever member when the handle member is in the closed position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
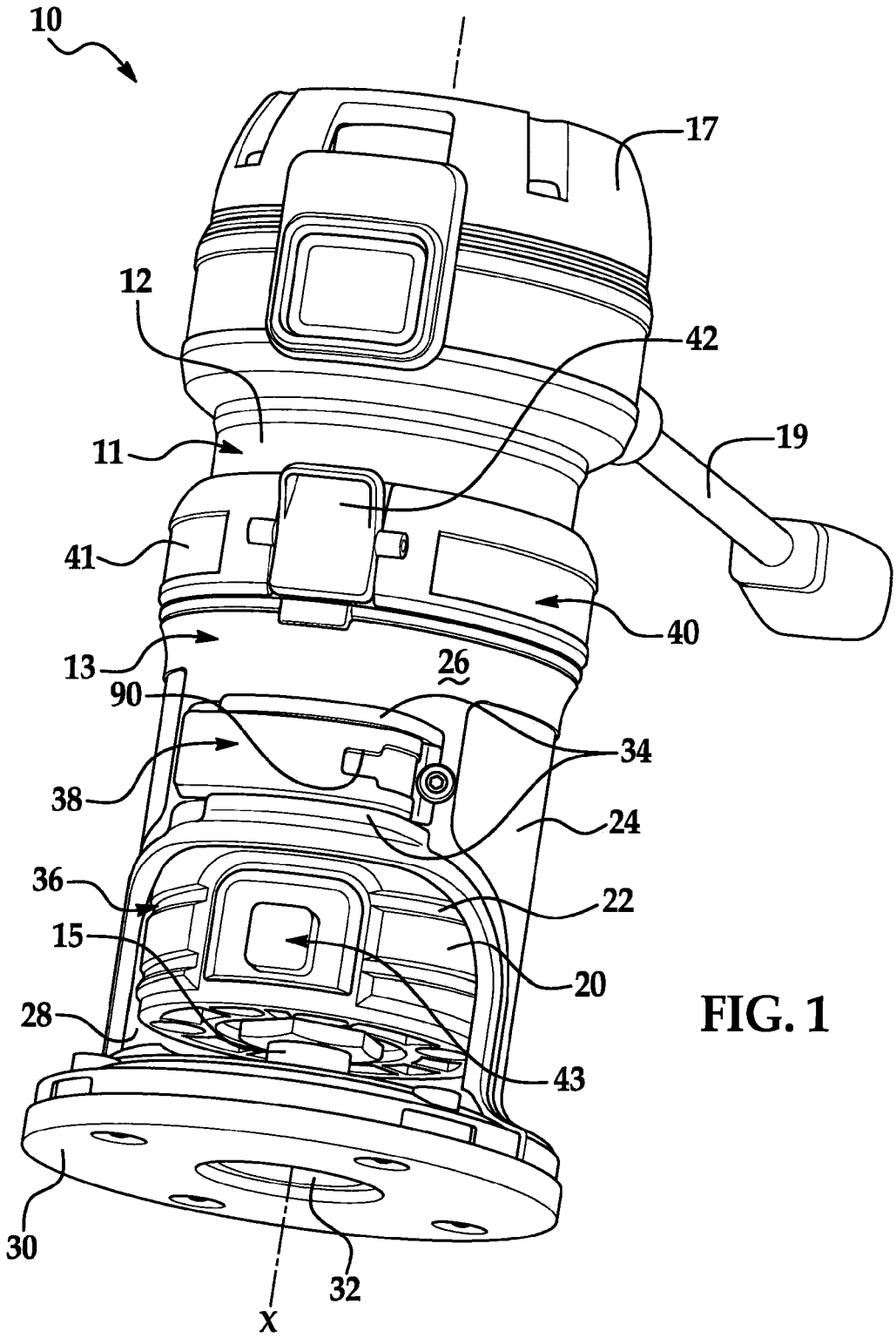
FIG. 1 is a perspective view of a power tool with a clamp assembly according to the present disclosure.

The following description is merely exemplary in nature and is not intended to limit the present disclosure, application, or uses. It should be understood that throughout the drawings, corresponding reference numerals indicate like or corresponding parts and features.

Referring initially to FIG. 1, a power tool 10 is illustrated. In the embodiment shown, the power tool 10 is a router; however, the power tool 10 could be of any suitable type without departing from the scope of the present disclosure. It will also be appreciated that certain components (e.g., handles, etc.) of the power tool 10 are not shown for purposes of clarity.

As shown, the power tool 10 generally includes a motor assembly 11 and a base assembly 13. The motor assembly 11 generally includes a motor housing 12, which is cylindrical in shape. The motor housing 12 encloses and supports a motor (not shown), which can be of any suitable type. A spindle assembly 15 extends out of the motor housing 12, and a tool (e.g., a routing bit, not shown) can be removably attached to the spindle assembly 15. The motor assembly 11 also includes an electronics housing 17 mounted atop the motor housing 12 on an end opposite the spindle assembly 15. The electronics housing 17 encloses and supports necessary electronics equipment (not shown), control switches, buttons, and displays, and other suitable components for operation of the power tool 10. A power cord 19 extends out of the electronics housing 17 and provides power to the power tool 10. It will be appreciated that the power tool 10 could be a cordless power tool 10 without departing from the scope of the present disclosure.

In the embodiment shown, the motor housing 12 is cylindrical and defines an outer surface 20 having a thread 22 formed thereon. The thread 22 allows the motor assembly 11 to adjust in height relative to the base assembly 13 as will be discussed.

Furthermore, in the embodiment shown, the base assembly 13 includes a cylindrical wall 24 defining an outer surface 26, an inner surface 28, and a longitudinal axis X. In the embodiment shown, the base assembly 13, the motor assembly 11, and the spindle assembly 15 each share the same axis X.

In the embodiment shown, the base assembly 13 also includes a support 30 coupled to a lower end of the wall 24. The support 30 is flat and disc-shaped. In one embodiment, the support 30 is made of a transparent material. The power tool 10 can be supported on a workpiece (not shown) via the support 30. The support 30 includes a central aperture 32 through which the spindle assembly 15 and/or a tool (e.g., a router bit) extend.

The wall 24 includes a plurality of flanges 34 that extend outwardly and horizontally in a direction transverse to the axis X. In the embodiment shown, there are two flanges 34 disposed in a spaced relationship to each other.

The wall 24 defines a cavity 36 that is sized to receive the motor assembly 11 therein. The power tool 10 further includes a clamp assembly 38. The clamp assembly 38 selectively provides a retention force F (FIG. 4) to removably couple the motor assembly 11 and the base assembly 13 as will be described in greater detail below. The clamp assembly 38 can be closed (as shown in FIGS. 1 and 4) to apply the retention force F to the motor assembly 11 and to retain the motor assembly 11 in position relative to the base assembly 13. The clamp assembly 38 can also be opened (FIG. 3) to change the position of the motor assembly 11 relative to the base assembly 13. In the embodiment shown, the clamp assembly 38 is operably coupled to the base assembly 13 to apply the retention force F to the motor assembly 11. It will be appreciated, however, that the clamp assembly 38 could be operably coupled to the motor assembly 11 so as to apply the retention force F to the base assembly 13 without departing from the scope of the present disclosure.

The power tool 10 also includes a height adjusting mechanism 40. In the embodiment shown, the height adjusting mechanism 40 includes a dial 41 provided near a top end of the base assembly 13 so as to encircle the motor assembly 11. The dial 41 is releasably fixed to the top end of the base assembly 13 via a release member, and is internally threaded so as to threadably engage with the thread 22 provided on the outer surface 20 of the motor assembly 11. Thus, assuming the clamp assembly 38 is in the open position, rotation of the motor assembly 11 relative to the base assembly 13 threadably advances the motor assembly 11 in either the downward or upward direction parallel to the axis X.

Also, the release member 42 can be biased such that the release member 42 disengages from the base assembly 13. Accordingly, the motor assembly 11 can move out of the base assembly 13, leaving the dial 41 threadably coupled to the motor assembly 11.

In the embodiment shown, the base assembly 13 is a fixed base, meaning that the base assembly 13 is rigid and the height adjusting mechanism 40 is used to adjust the height of motor assembly 11 relative to the workpiece. However, it will be appreciated that the base assembly 13 could be a plunge base assembly 13 that is collapsible to actuate the motor assembly 11 toward and away from the workpiece without departing from the scope of the present disclosure.

Furthermore, the power tool 10 includes a spindle lock assembly 43 that selectively locks the spindle assembly 15 against rotation about the axis X. More specifically, the spindle lock assembly 43 can selectively lock the spindle assembly 15 against rotation to attach and/or remove a tool (e.g., a routing bit) to/from the spindle assembly 15.

The clamp assembly 38 will now be discussed in greater detail with reference to FIGS. 1-4. The clamp assembly 38 includes a handle member 44 (FIGS. 3 and 4). (The handle member 44 is not shown in FIG. 2 for clarity.) The handle member 44 is elongate and rectangular with a slight curvature about the axis X as shown in FIGS. 3 and 4. A first end 45 of the handle member 44 includes an indent 46 as shown in FIG. 4. The indent 46 provides access for a user to grab an inner surface of the handle member 44 and move the handle member 44 from the closed position (FIG. 4) to the open position (FIG. 3). As shown, the handle member 44 is provided between the flanges 34 and is substantially flush with the flanges 34 when in the closed position such that the clamp assembly 38 has a relatively low profile relative to the base assembly 13.

A second end 47 of the handle member 44 includes a plurality of rounded projections 50 (FIGS. 3 and 4). A pin 48 is coupled to the projections 50 at each end and extends parallel to the axis X between the projections 50. The projections 50 are rounded so as to be eccentric relative to the axis of the pin 48. As will be described in greater detail below, the projections 50 define cam surfaces 52 for clamping and unclamping the clamp assembly 38. As stated, the handle member 44 can move between the closed position (FIG. 4) and the open position (FIG. 3). The handle member 44 rotates about the axis of the pin 48 when moving between the open and closed positions.

As will be explained, the clamp assembly 44 provides the retention force F against the motor assembly 11 when the handle member 44 is in the closed position (FIG. 4) to maintain the motor assembly 11 in position relative to the base assembly 13. When the handle member 44 is in the open position (FIG. 3), the retention force F is reduced or eliminated, and the motor assembly 11 can move parallel to the axis X relative to the base assembly 13.

Figure 2:
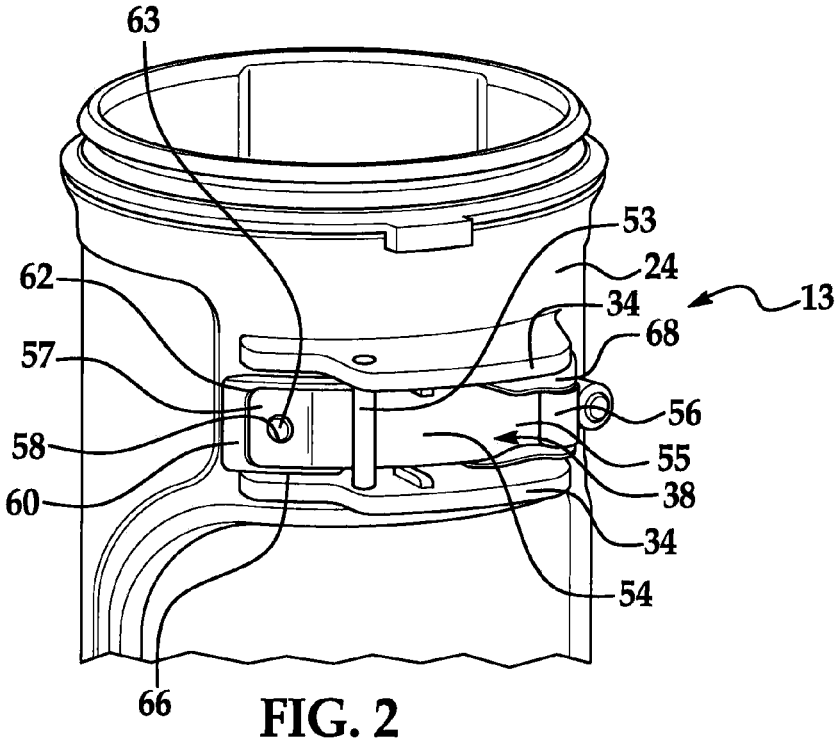
FIG. 2 is a perspective view of the power tool of FIG. 1 with the handle member of the clamp assembly removed for clarity.
Figure 3:
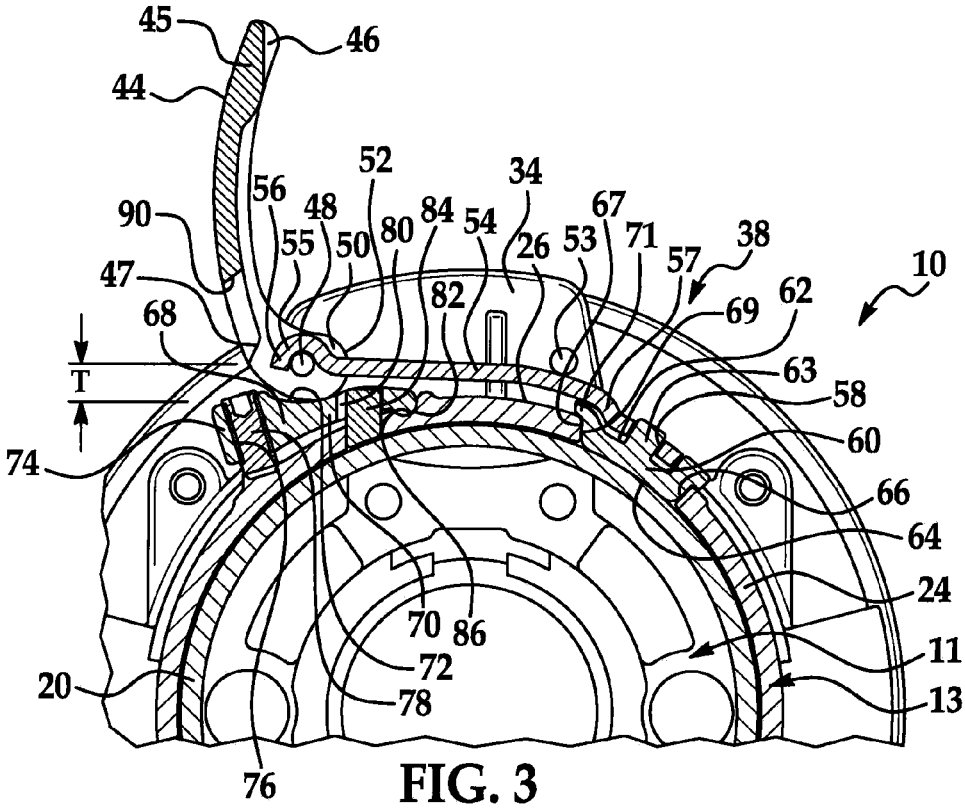
FIG. 3 is a section view of the power tool of FIG. 1 with the clamp assembly shown in an open position.
Figure 4:
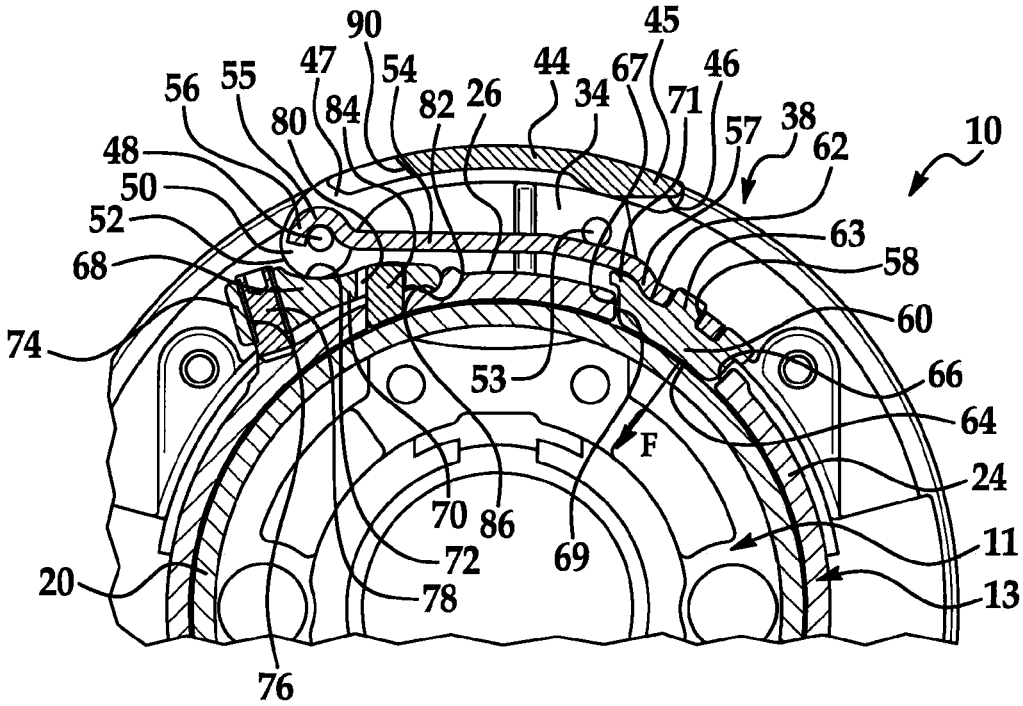
FIG. 4 is a section view of the power tool of FIG. 1 with the clamp assembly shown in a closed position.

The clamp assembly 38 also includes a fulcrum member 53 (FIGS. 2-4). In one embodiment, the fulcrum member 53 is a rigid pin that is fixed at both ends to one of the flanges 34. More specifically, the fulcrum member 53 extends substantially parallel to the axis X between the flanges 34. As will be described, the fulcrum member 53 provides a surface against which other components of the clamp assembly 38 can abut and rotate. It will be appreciated that the fulcrum member 53 could be of any suitable structure for providing such a surface.

The clamp assembly 38 further includes a biasing lever member 54. In the embodiment shown, the biasing lever member 54 is elongate and thin. The biasing lever member 54 can be made out of a resilient, metallic material. The biasing lever member 54 is provided between the fulcrum member 53 and the outer surface 26 of the base assembly 13. The biasing lever member 54 includes a first portion 55 and a second portion 57 on opposite sides of the fulcrum member 53. In the embodiment shown, the first portion 55 of the biasing lever member 54 is longer than the second portion 57. As such, the biasing lever member 54 provides a mechanical advantage when closing and opening the clamp assembly 38 as described in greater detail below.

The first portion 55 of the lever member 54 includes a hook 56 (FIGS. 3 and 4), which partially encircles the pin 48 to thereby couple to the pin 48. More specifically, the hook 56 partially encircles the pin 48 on an outboard side of the pin 48. Thus, movement of the pin 48 in a direction radially away from the axis X coincidentally causes movement of the first portion 55 of the lever member 54 radially away from the axis X. The second portion 57 of the biasing lever member 54 is curved slightly toward the axis X and includes an opening 58.

The clamp assembly 38 additionally includes a clamp pad 60 (FIGS. 2-4). The clamp pad 60 can be made out of any suitable material, such as zinc or DELRIN polymer, or other resilient polymer. The clamp pad 60 includes a recess 62 that receives the second portion 57 of the biasing lever member. The clamp pad 60 further includes a post 63 extending outwardly from the recess 62 and away from the axis X. The post 63 is received within the opening 58 of the biasing lever member 54 to couple the clamp pad 60 to the second portion 57 of the biasing lever member 54. In one embodiment, the clamp pad 60 is fixedly coupled to the biasing lever member 54. In another embodiment, the clamp pad 60 is movably coupled to the biasing lever member 54. The clamp pad 60 also defines a retaining surface 64 (FIGS. 3 and 4) on an inner surface thereof.

As will be described, the retaining surface 64 of the clamp pad 60 selectively abuts the motor assembly 11 to transfer retention force F from the biasing lever member 54 and to removably couple the base assembly 13 and the motor assembly 11. More specifically, the clamp pad 60 is received in an aperture 66 formed through the wall 24 of the base assembly 13. In some embodiments, the aperture 66 is a through hole such that the wall 24 of the base assembly 13 continuously and completely surrounds the clamp pad 60. Movement of the biasing lever member 54 causes movement of the clamp pad 60 in the aperture 66 of the base assembly 13 such that the clamp pad 60 applies the retention force F to the motor assembly 11. In other words, the retaining surface 64 moves toward and away from the motor assembly 11 due to movement of the biasing lever member 54.

In the embodiment shown, the clamp pad 60 includes a tapered support surface 67. The base assembly 13 also includes a corresponding tapered support surface 69 on the periphery of the aperture 66. The support surfaces 67, 69 abut each other so as to limit movement of the clamp pad 60 out of the aperture 66. In other words, because of the abutment of the support surfaces 67, 69, the clamp pad 60 is unlikely to be pulled out of the aperture 66 by the biasing lever member 54 when the clamp assembly 38 is moved from the open position to the closed position.

Furthermore, in the embodiment shown, the clamp pad 60 includes a flange 71. The flange 71 is located outside the base assembly 13 and at least partially overlaps the periphery of the aperture 66 to ensure proper alignment of the clamp pad 60 and the aperture 66.

In addition, the clamp assembly 38 includes an adjustment member 68 (FIGS. 3 and 4). The adjustment member 68 includes a first end 70. The first end 70 includes a support surface 72 against which the cam surfaces 52 of the handle member 44 slidingly abut. A second end 74 of the adjustment member 68 includes an aperture 76. In the embodiment shown, a set screw 78 extends through the aperture 76 and threadably couples to the adjustment member 68 and the wall 24 of the base assembly 13. The set screw 78 also movably couples the adjustment member 68 to the wall 24 of the base assembly 13. In other words, rotation of the set screw 78 adjusts the position of the adjustment member 68 in a direction transverse to the axis X toward and away from the outer surface 26 of the wall 24 of the base assembly 13. As will be described, adjusting the position of the adjustment member 68 changes the amount of retention force F provided by the clamp assembly 38.

Furthermore, the first end 70 of the adjustment member 68 includes an aperture 80 and a rounded pivot surface 82. In addition, a retaining pin 84 is fixed to the wall 24 of the base assembly 13, and a pivoting indent 86 is defined in the outer surface 26 of the wall 24. The retaining pin 84 is received in the aperture 80, and the pivot surface 82 is received in the pivoting indent 86. As such, the retaining pin 84 couples the first end 70 of the adjustment member 68 to the wall 24 and positionally retains the adjustment member 68 such that movement of the adjustment member 68 in a tangential direction relative to the wall 24 is limited. Moreover, when the set screw 78 is turned, the adjustment member 68 is able to pivot about the pivot surface 82 due to the sliding abutment of the pivot surface 82 on the pivoting indent 86.

Now, with reference to FIGS. 3 and 4, the opening and closing of the clamp assembly 38 will be described in greater detail. When moving from the open position (FIG. 3) to the closed position (FIG. 4), the handle member 44 pivots about the axis of the pin 48 such that the first end 45 of the handle member 44 moves toward the outer surface 26 of the base assembly 13. Simultaneously, the cam surfaces 52 of the handle member 44 cam against the support surface 72 of the adjustment member 68. As the cam surfaces 52 slide on the support surface 72, the pin 48 is moved outward away from the axis X and the outer surface 26 of the base assembly 13. The pin 48 pulls the hook 56 away from the axis X to actuate the first portion 55 of the biasing lever member 54 away from the axis X and the outer surface 26 of the base assembly 13. As such, the biasing lever member 54 actuates relative to the fulcrum member 53. More specifically, in the embodiment shown, the first portion 55 of the biasing lever member 54 rotates about the fulcrum member 53 generally away from the axis X, and the second portion 57 of the biasing lever member 54 rotates about the fulcrum member 53 generally toward the axis X in order to apply the retention force F. In some embodiments, the biasing lever member 54 resiliently deflects (i.e., bends) against the fulcrum member 53 and biases the second portion 57 and clamp pad 60 toward the motor assembly 11 to provide the retention force F against the motor assembly 11. Accordingly, the biasing lever member 54 deflects to provide the retention force F, and the clamp pad 60 transfers the retention force F to the motor assembly 11 to thereby retain the motor assembly 11 in position relative to the base assembly 13.

In contrast, when the handle member 44 is moved from the closed position (FIG. 4) to the open position (FIG. 3), the cam surfaces 52 slide against the support surface 72, allowing the biasing lever member 54 to deflect back or recover toward its undeflected shape and rotate about the fulcrum member 53, and the biasing lever member 54 pulls the pin 48 toward the axis X and toward the outer surface 26 of the base assembly 13. This movement of the pin 48 reduces the deflection of the biasing lever member 54, and allows the clamp pad 60 to move away from the axis X and the motor assembly 11. Accordingly, the retention force F is reduced, and the motor assembly 11 can be moved parallel to the axis X relative to the base assembly 13.

As mentioned above, the adjustment member 68 can be positionally adjusted via the set screw 78 to change the amount of retention force F provided by the clamp assembly 38. More specifically, rotation of the set screw 78 moves the support surface 72 toward and away from the outer surface 26 of the base assembly 13. Thus, if the support surface 72 is moved away from the outer surface 26, the cam surfaces 52 cam the pin 48 further away from the axis X and the outer surface 26 (i.e., there is more throw T of the pin 48), thereby causing increased resilient deflection of the biasing lever member 54. As such, the retention force F provided by the clamp assembly 38 is increased. In contrast, if the support surface 72 is adjusted toward the axis X and the outer surface 26, the cam surfaces 52 cause less movement of the pin 48 away from the outer surface 26 (i.e., there is less throw T of the pin 48) for less resilient deflection of the biasing lever member 54. Accordingly, less retention force F is provided by the clamp assembly 38. In one embodiment, the adjustment member 68 is adjusted to provide approximately 2 mm of throw T.

It will be appreciated that the set screw 78 can be threadably advanced with a screwdriver (not shown) or other suitable tool. The set screw 78 can be advanced when the handle member 44 is in the closed position and in the open position. For instance, in some embodiments, the handle member 44 includes an opening 90 (FIG. 1) adjacent the second end 47. The set screw 78 can be accessed and adjusted through the opening 90 when the handle member 44 is in the open position. For instance, when the handle member 44 is in the open position, a screwdriver (not shown) can be inserted through the opening 90 to threadably advance the set screw 78. The set screw 78 can be adjusted until there is little or no play in the handle member 44 (i.e., the handle member 44 is freely supported approximately orthogonal to the axis X when in the open position) while still allowing the motor assembly 13 to be removed from the base assembly 11.

It will be appreciated that the power tool 10 could be configured such that the cam surfaces 52 cam directly against the outer surface 26 of the base assembly 13. In other words, the adjustment member 68 is not included in some embodiments. Furthermore, it will be appreciated that the clamp assembly 38 could be coupled to the motor assembly 11 such that the clamp pad 60 abuts against the base assembly 13 without departing from the scope of the present disclosure. Also, in some embodiments, the clamp pad 60 is not included, and the second portion 57 of the biasing lever member 54 abuts directly against the motor assembly 11 to thereby apply the retention force F. Still further, the wall 24 of the base assembly 13 could include a flexible portion, and the biasing lever member 54 can abut against the flexible portion when the handle member 44 is in the closed position to deflect and hold the flexible portion against the motor assembly 13.

It will be appreciated that the necessary input force from the user applied to the handle member 44 is relatively low compared to prior art clamp assemblies. This is because the biasing lever member 54 provides a mechanical advantage and reduces the necessary input force provided by the user and applied to the cam surfaces 52. Thus, the clamp assembly 38 is easier for the user to operate, and the cam surfaces 52 and the support surface 72 are less likely to wear.

Furthermore, the retention force F provided by the clamp assembly 38 can be easily adjusted as described above. The adjustment member 68 can also be adjusted to reduce the amount of sagging (i.e., looseness) of the clamp assembly 38 when in the open position. For instance, the retention force F can be adjusted by the manufacturer and/or the user by simply turning the set screw 78 until the clamp pad 60 abuts slightly against the motor assembly 11 when the clamp assembly 38 is in the open position. As such, the retention force F with be relatively low (e.g., zero) when the clamp assembly 38 is in the open position, but as soon as the clamp assembly 38 begins to move toward the closed position, the retention force F begins to increase. Thus, the clamp assembly 38 is less likely to hang loosely or sag relative to the motor assembly 13 when in the open position. Accordingly, the clamp assembly 38 can be moved to the closed position without having to pre-align the components as is the case with some prior art clamp assemblies.

Furthermore, if a user over tightens the clamp assembly 38 while in the closed position, it will be difficult to remove the motor assembly 11 from the base assembly 13 even in the open position. This will discourage users from over tightening the set screw 78.

Moreover, manufacture of the clamp assembly 38 in the power tool 10 is relatively simple. For instance, the base assembly 13 can be cast, and the aperture 66 can be formed during casting operation. Then, a hole for the fulcrum member 53 can be machined to then attach the fulcrum member 53 before attaching the remaining components of the clamp assembly 38. Thus, tolerancing can be relatively loose, and proper operation of the clamp assembly 38 can be ensured. Furthermore, the power tool 10 can be less expensive to manufacture.

Finally, the clamp assembly 38 has a relatively low profile. More specifically, each of the components remains significantly contained between the flanges 34 of the base assembly 13. As such, the power tool 10 is more compact, and the clamp assembly 38 is less likely to cause interference with surrounding structure.

Figure 5:
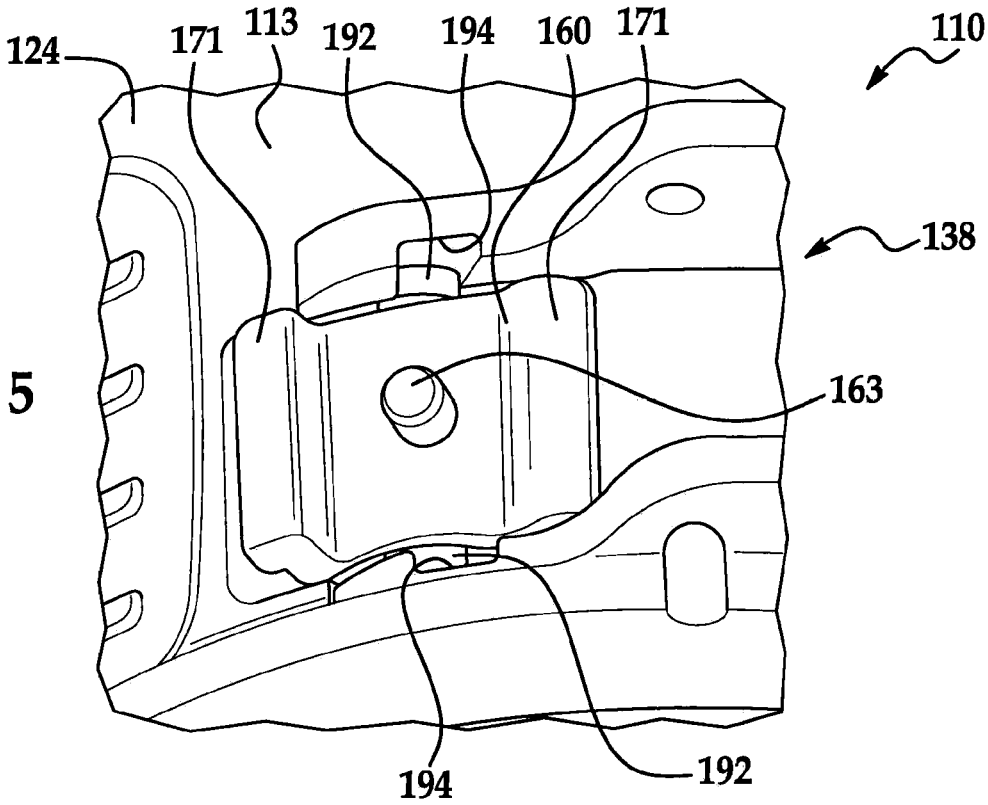
FIG. 5 is a perspective view of a portion of a portion of a clamp assembly according to another embodiment.

Referring now to FIG. 5, another embodiment of the clamp assembly 138 is illustrated. Components that correspond to those discussed above in relation to FIGS. 1-4 are identified by corresponding reference numerals increased by 100. Only the clamp pad 160 and the wall 124 of the base assembly 113 are shown for purposes of clarity; however, it will be appreciated that the clamp assembly 138 can include other components similar to those discussed above with relation to FIGS. 1-4.

The tool 110 includes a clamp pad 160 with a post 163, and flanges 171 similar to the embodiment of FIGS. 1-4. The clamp pad 160 also includes extensions 192. The extensions 192 each extend from opposite sides of the clamp pad 160 in a direction generally parallel to the axis X of the tool 110. In some embodiments, the extensions 192 are integrally attached to the clamp pad 160. The extensions 192 can have any suitable shape, such as a cylindrical shape.

The extensions 192 are received in corresponding slots 194 of the wall 124 of the base assembly 113. The extensions 192 are substantially retained in the slots 194, and hence the clamp pad 160 is substantially coupled to the wall 124. Thus, the clamp pad 160 can be easier to fit and position on the wall 124 of the base assembly 113, and the clamp assembly 138 is less sloppy when opened since the clamp pad 160 is more likely to be retained in the wall 124 of the base assembly 113.

The foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. A power tool comprising:

a motor assembly;

a base assembly; and a clamp assembly coupled to one of the motor assembly and the base assembly to selectively provide a retention force to the other of the motor assembly and the base assembly to removably couple the motor assembly and the base assembly, the clamp assembly including a handle member, a fulcrum member, and a biasing lever member, the biasing lever member including a first portion and a second portion disposed on opposite sides of the fulcrum member, the handle member rotatably coupled to the first portion of the biasing lever member, the handle member movable between an open position and a closed position, the handle member pivoting the first and second portions of the biasing lever member about the fulcrum member when moving from the open position to the closed position, causing the second portion of the biasing lever member to increase the retention force to removably couple the motor assembly and the base assembly, and the handle member pivoting the first and second portions of the biasing lever member about the fulcrum member when moving from the closed position to the open position, causing the second portion of the biasing lever member to reduce the retention force.

2. The power tool of claim 1, wherein the first portion of the biasing lever member is longer than the second portion.

3. The power tool of claim 1, wherein the handle member rotates and resiliently deflects the biasing lever member when moving from the open position to the closed position, causing the second portion of the biasing lever member to provide the retention force.

4. A power tool comprising:

a motor assembly;

a base assembly;

a clamp assembly coupled to one of the motor assembly and the base assembly to selectively provide a retention force to the other of the motor assembly and the base assembly to removably couple the motor assembly and the base assembly, the clamp assembly including a handle member, a fulcrum member, and a biasing lever member, the biasing lever member including a first portion and a second portion disposed on opposite sides of the fulcrum member, the handle member coupled to the first portion of the biasing lever member, the handle member movable between an open position and a closed position, the handle member rotating the first and second portions of the biasing lever member about the fulcrum member when moving from the open position to the closed position, causing the second portion of the biasing lever member to provide the retention force to removably couple the motor assembly and the base assembly, and the handle member rotating the first and second portions of the biasing lever member about the fulcrum member when moving from the closed position to the open position, causing the second portion of the biasing lever member to reduce the retention force; and further comprising an adjustment member moveably coupled to the one of the motor assembly and the base assembly, the adjustment member being moveable relative to the one of the motor assembly and the base assembly to change an amount of the retention force provided by the biasing lever member when the handle member is in the closed position.

5. The power tool of claim 4, wherein the one of the motor assembly and the base assembly defines an axis, and wherein the adjustment member is positionally adjustable in a direction transverse to the axis to change the amount of the retention force provided by the biasing lever member.

6. The power tool of claim 5, further comprising a set screw that adjustably couples the adjustment member to the one of the motor assembly and the base assembly.

7. The power tool of claim 4, further comprising a pin that is fixedly coupled to the one of the motor assembly and the base assembly and that is received in an aperture of the adjustment member to couple the adjustment member to the one of the motor assembly and the base assembly.

8. The power tool of claim 4, wherein the adjustment member includes a rounded pivot surface, and wherein the one of the base assembly and the motor assembly includes a pivoting indent that receives and pivotally supports the pivot surface.

9. The power tool of claim 1, wherein the one of the motor assembly and the base assembly defines an axis, wherein the handle member includes a cam surface and the clamp assembly includes a support surface, the cam surface camming against the support surface, thereby pulling the first portion of the biasing lever member away from the axis to rotate the first and second portions of the biasing lever member about the fulcrum, thereby causing the second portion of the biasing lever member to provide the retention force.

10. A power tool comprising:

a motor assembly;

a base assembly; and a clamp assembly coupled to one of the motor assembly and the base assembly to selectively provide a retention force to the other of the motor assembly and the base assembly to removably couple the motor assembly and the base assembly, the clamp assembly including a handle member, a fulcrum member, and a biasing lever member, the biasing lever member including a first portion and a second portion disposed on opposite sides of the fulcrum member, the handle member rotatably coupled to the first portion of the biasing lever member, the handle member movable between an open position and a closed position, the handle member pivoting the first and second portions of the biasing lever member about the fulcrum member when moving from the open position to the closed position, causing the second portion of the biasing lever member to increase the retention force to removably couple the motor assembly and the base assembly, and the handle member pivoting the first and second portions of the biasing lever member about the fulcrum member when moving from the closed position to the open position, causing the second portion of the biasing lever member to reduce the retention force; and a clamp pad coupled to the second portion of the biasing lever member, the clamp pad selectively abutting the other of the base assembly and the motor assembly upon pivotal movement of the biasing lever member to apply the retention force and removably couple the base assembly and the motor assembly.

11. The power tool of claim 10, wherein the one of the base assembly and the motor assembly includes an aperture that receives the clamp pad.

12. The power tool of claim 11, wherein the clamp pad includes a tapered support surface, wherein the one of the base assembly and the motor assembly includes a tapered support surface on a periphery of the aperture, and wherein the tapered support surface of the clamp pad abuts against the tapered support surface of the one of the base assembly and the motor assembly to limit movement of the clamp pad out of the aperture.

13. The power tool of claim 11, wherein the clamp pad includes a flange disposed outside the one of the base assembly and the motor assembly, wherein the flange at least partially overlaps a periphery of the aperture.

14. The power tool of claim 1, wherein the one of the motor assembly and the base assembly includes a flange, and wherein the fulcrum member is fixed to the flange.

15. The power tool of claim 1, further comprising a pin coupled to the handle member, the handle member rotating about an axis defined by the pin, wherein the first portion of the biasing lever member includes a hook that is coupled to the pin.

16. The power tool of claim 1, wherein the one of the motor assembly and the base assembly defines an axis, and the biasing lever member is disposed between the axis and the fulcrum member.

17. A router comprising:

a motor assembly;

a base assembly defining an aperture and an axis; and a clamp assembly coupled to the base assembly to selectively provide a retention force to removably couple the motor assembly and the base assembly, the clamp assembly including a handle member with a pin coupled thereto, a fulcrum member fixed to the base assembly, a biasing lever member with a first portion having an end rotatably coupled to the pin, an adjustment member moveably coupled to the base assembly, and a clamp pad coupled to a second portion of the biasing member and being received by the aperture, the first and second portions of the biasing lever member disposed on opposite sides of the fulcrum member, the first portion of the biasing lever member being longer than the second portion, the handle member rotatable about an axis defined by the pin between an open position and a closed position, the handle member camming against the adjustment member when rotating from the open position to the closed position to thereby moving the pin away from the axis, moving the end of the first portion radially away from the axis, and pivoting the first and second portions of the biasing lever member about the fulcrum member, thereby resiliently deflecting the biasing lever member, thereby biasing the clamp pad against the motor assembly to increase the retention force, the adjustment member being moveable relative to the motor assembly to change an amount of the retention force provided by the biasing lever member when the handle member is in the closed position.

18. The router of claim 17, wherein the clamp pad includes a flange disposed outside the base assembly, and wherein the flange at least partially overlaps a periphery of the aperture.

19. The router of claim 17, wherein the base assembly defines an axis, and the biasing lever member is disposed between the axis and the fulcrum member.

* * * * *